US007487817B2

(12) United States Patent
Liang

(10) Patent No.: US 7,487,817 B2
(45) Date of Patent: Feb. 10, 2009

(54) NON-PULL CORD OPERABLE WINDOW BLIND STRUCTURE

(75) Inventor: Wen Ying Liang, Changhua Hsien (TW)

(73) Assignee: Ching Feng Home Fashions Co., Ltd., Changhua Hsien (TW)

( * ) Notice: Subject to any disclaimer, the term of this patent is extended or adjusted under 35 U.S.C. 154(b) by 264 days.

(21) Appl. No.: 11/449,681

(22) Filed: Jun. 9, 2006

(65) Prior Publication Data

US 2007/0284060 A1 Dec. 13, 2007

(51) Int. Cl.
*E06B 9/322* (2006.01)

(52) U.S. Cl. ..... 160/170; 160/84.04

(58) Field of Classification Search ..... 160/170, 160/171, 84.01, 84.04, 84.05, 168.1 R, 173 R, 160/178.1 R, 172; 242/372
See application file for complete search history.

(56) References Cited

U.S. PATENT DOCUMENTS 6,508,293 B1 * 1/2003 Huang ..... 160/170
7,093,644 B2 * 8/2006 Strand ..... 160/170
2007/0119547 A1 * 5/2007 Liang ..... 160/170
2007/0125505 A1 * 6/2007 Liang ..... 160/170

FOREIGN PATENT DOCUMENTS

WO WO 9209779 * 6/1992

* cited by examiner

*Primary Examiner*—Blair M. Johnson
(74) *Attorney, Agent, or Firm*—Troxell Law Office, PLLC

(57) ABSTRACT

A non-pull cord operable window blind structure comprises lift cords assembled onto corresponding positions of a head rail, a bottom rail, and a blind body wherein a cord-winding control device with an operational cord attached thereto, and a fixed seat are mounted to both end sides of an accommodating channel of the head rail with a movable seat situated to slide there-between. The fixed and movable seats respectively have multiple guiding elements for the winding of the lift cords. An insert block attached at one end of the operational cord and an insert cavity defining one side of the movable seat are correspondingly engaged with each other, permitting the operational cord actuated by the sliding of the movable to move in linkage to the lift cords. Therefore, the bottom rail is simply pushed or pulled by hands to adjust the blind body into a desirable collected or expanded position thereby.

9 Claims, 5 Drawing Sheets

NON-PULL CORD OPERABLE WINDOW BLIND STRUCTURE

BACKGROUND OF THE INVENTION

The present invention relates to a non-pull cord operable window blind structure, comprising an operational cord attached to a cord-winding control device and actuated by a movable seat that, along with a fixed seat, has lift cords wound thereon; whereby a bottom rail is simply pushed or pulled by hands to freely adjust the height of a blind body in an easy manner without the hands getting hurt by the conventional pull cords. Besides, an insert block attached at one end of the operational cord and a positioning block defined by an insert cavity at one side of the movable seat are provided and capable of engaging with or detaching from each other, facilitating easy and flexible assembly of the operational cord and the movable seat thereby.

Conventional window blinds usually have pull cords mounted to suspend at one side of a blind body and retained in position by a pulley assembly to collect or expand the blind body thereby. In operation, the pull cords are drawn by force of hands to adjust the position of the blind body. Due to the small frictional surface thereof, the pull cords tend to rub against the hands or even abrade the hands directly contacting with them in an uncomfortable way if the pull cords are drawn to slide too fast. Furthermore, the pull cords are retained in place by the pulley assembly and are subjected to bear the total weight of the blind body. Thus, great efforts must be spent to draw the pull cords in operation, and the pull cords can easily get stuck in the pulley assembly, resulting in an awkward operation and becoming unsuitable for users of younger ages. Besides, in case of an excessive down-pulling force exerted onto the pull cords or a sudden release of the pull cords at great speed, the blind body cannot be accurately positioned in a desirable position and the adjustment process must be repeated over again, which is quite inconvenient in operation.

SUMMARY OF THE PRESENT INVENTION

It is, therefore, the primary purpose of the present invention to provide a non-pull cord operable window blind structure wherein an operational cord attached to a cord-winding control device cooperatively works in linking movement with a movable seat and a fixed seat with lift cords wound thereon so that a bottom rail is simply pushed or pulled by hands to freely adjust the height of a blind body in an easy manner without the hands getting abraded by the conventional pull cords, achieving the best state of application thereby.

It is, therefore, the second purpose of the present invention to provide a non-pull cord operable window blind structure wherein the cord-winding control device is equipped with torsion springs whose elasticity permit the operational cord to precisely recoil and locate in place according to the pushing/pulling force applied by the hands onto the bottom rail and the lift cords, avoiding the inconvenience of re-adjustment found in the conventional pull cords above to achieve more accurate and easier operation as well as assembly thereby.

It is, therefore, the third purpose of the present invention to provide a non-pull cord operable window blind structure wherein an insert block attached at one end of the operational cord and a positioning block defined by an insert cavity at one side of the movable seat are provided and capable of engaging with or detaching from each other, facilitating easy and flexible assembly of the operational cord and the movable seat thereby.

DETAILED DESCRIPTION OF THE PREFERRED EMBODIMENTS

Figure 1:
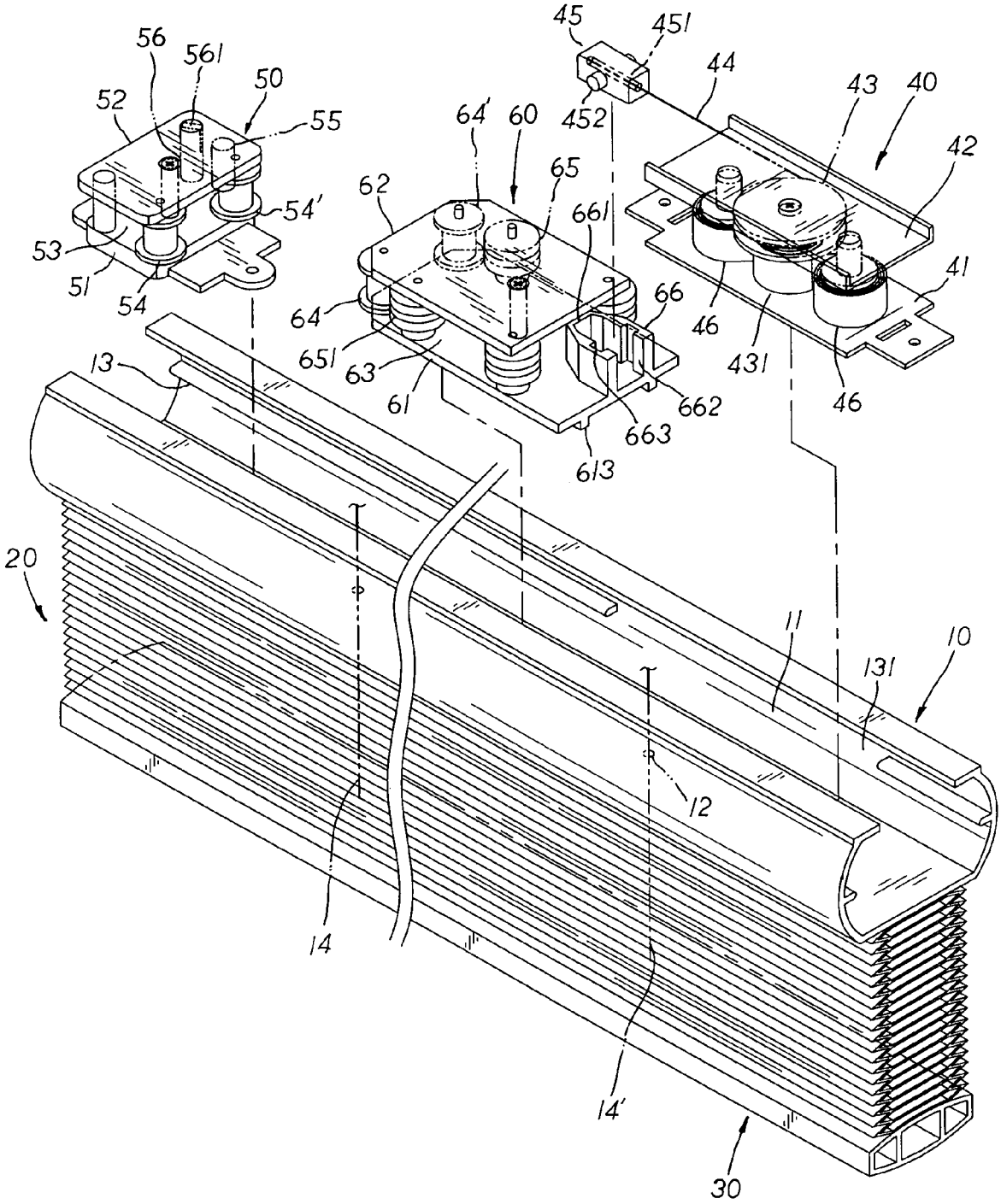
FIG. 1 is an exploded perspective view of the present invention.
Figure 2:
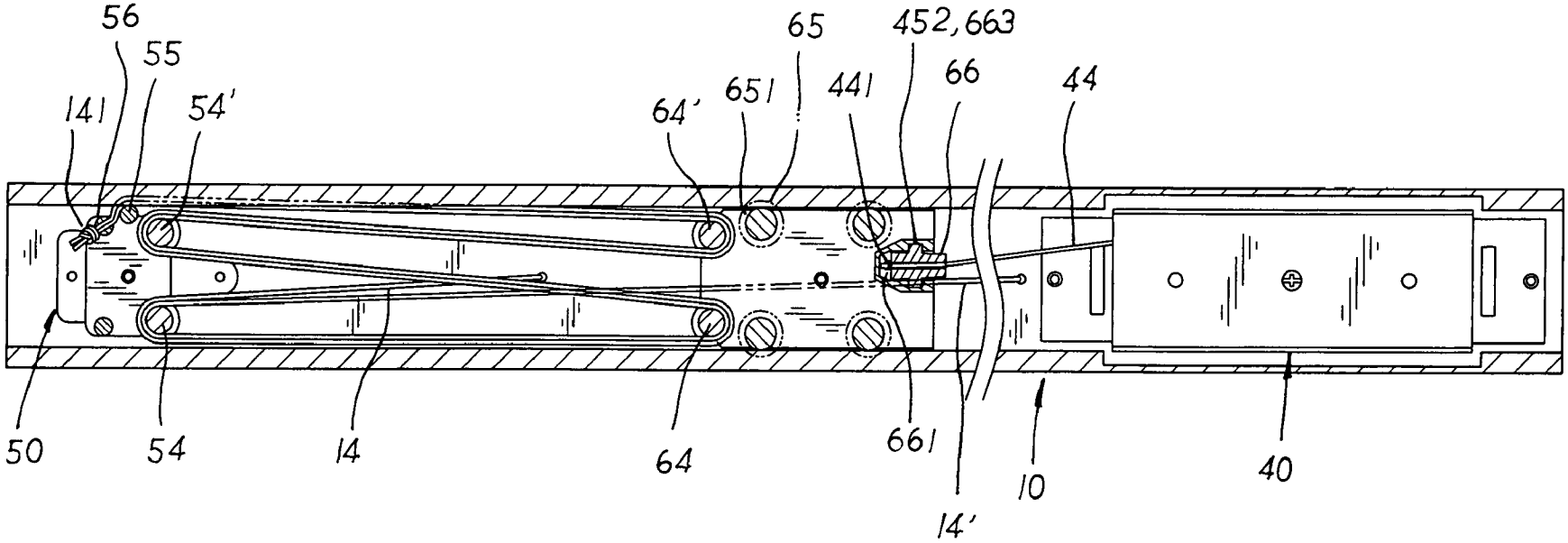
FIG. 2 is an assembled cross sectional view of the present invention.

Please refer to FIG. 1 showing an exploded perspective view of the present invention. The present invention relates to a non-pull cord operable window blind structure, comprising a head rail 10, a blind body 20, a bottom rail 30, a cord-winding control device 40, a fixed seat 50, and a movable seat 60. The upper side of the head rail 10 is defined by an accommodating channel 11 with cord passages 12 disposed thereon, and both internal side walls of the accommodating channel 11 are disposed a pair of symmetrically-extending guide tracks 13 each having a positioning recess 131 cut thereon. The blind body 20 is fixed between the head rail 10 and the bottom rail 30 thereof, and two or more than two lift cords 14, 14' are mounted to the corresponding locations of the blind body 20 and the bottom rail 30 thereon. One end of each lift cord 14, 14' is guided to pass through the cord passage 12 of the head rail 10 while the other end thereof is fixed to the bottom rail 30 thereon. The cord-winding control device 40 is equipped with a base 41, a top plate 42, and a rotary seat 43 mounted between the base 41 and the top sheet 42. An operational cord 44 is attached to the rotary seat 43 at one end and wound thereon. And an insert block 45 with a bore 451 drilled therein is provided for the other end of the operational cord 44 to extend there-through before fixed to form a stably attached end 441 thereby as shown in FIG. 2. The insert block 45 also has a set of coupling rods 452 protruding at both lateral sides thereon. The bottom surface of the rotary seat 43 has a smaller-diameter rotating shaft 431 protruding thereon, and both sides of the rotating shaft 431 have a torsion spring 46 attached thereto respectively so that, depending on the actuation of the operational cord 44 and the clockwise/counterclockwise spinning direction of the rotary seat 43, the torsion springs 46 are allowed to wind or counter-wind along the rotating shaft 431 and elastically locate in place thereby. The fixed seat 50 and the movable seat 60 are respectively equipped with a set of bottom and upper boards 51, 52, 61, 62 to form a winding groove 53, 63 there-between correspondingly. And both winding grooves 53, 63 have multiple guiding elements 54, 54', 64, 64' vertically extending at one side thereon wherein the amount of the guiding elements 54, 54', 64, 64', depending on the length of the lift cords 14, 14' can be respectively set into two or more than two in number. The winding groove 53 of the fixed seat 50 also has a guide rod 55 and a positioning rod 56 with a recess 561 cut thereon disposed at the other lateral side thereon. And the other side of the winding groove 63 of the movable seat 60 is disposed multiple symmetrically-arranged and larger-diameter pulleys 65 each having a grooved path 651 cut thereon. The bottom board 61 of the movable seat 60 also has a positioning block 66 disposed at one side thereon wherein the positioning block 66 is equipped with an insert cavity 661 defining therein, an opening edge 662 disposed at one end thereon communicating with the insert cavity 661 thereby, and a set of coupling recesses 663 symmetrically indented at both lateral side walls of the insert cavity 661 thereon. The width of the coupling recess 663 is slightly smaller than the outer diameter of the coupling rod 452 thereof. And the bottom board 61 of the movable seat 60 also has multiple supporting legs 613 extending downwards at the underside thereon.

Figure 3:
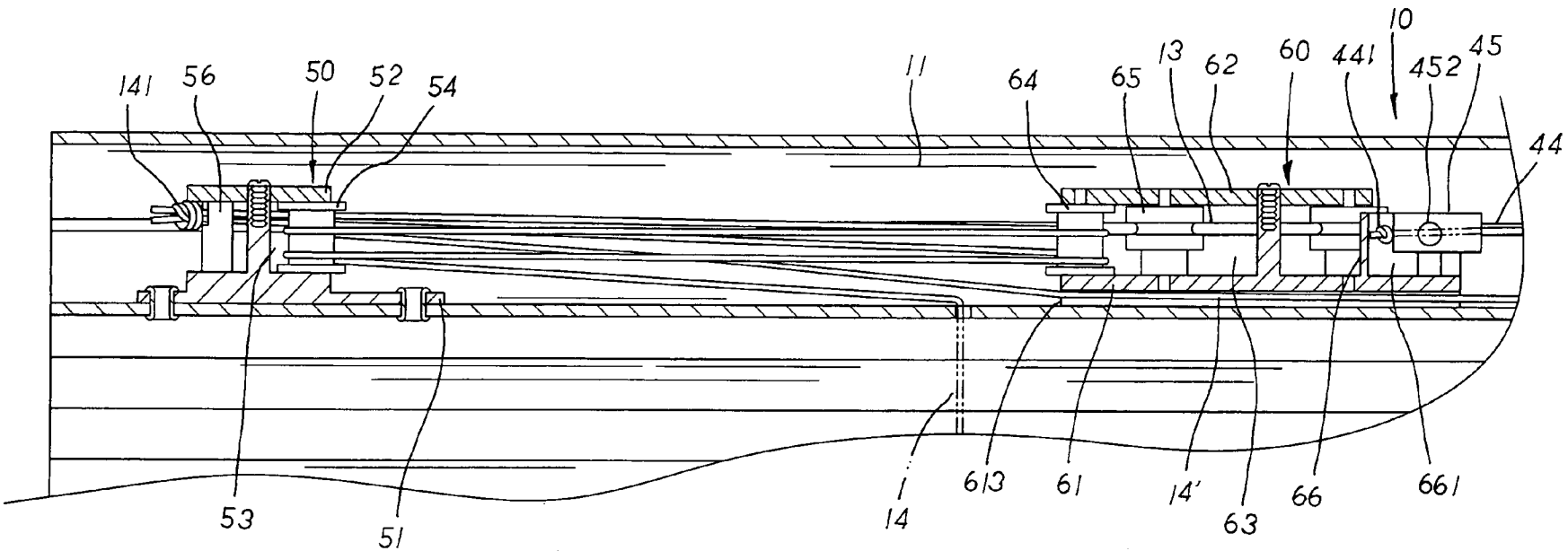
FIG. 3 is a partially enlarged and cross sectional view of the present invention.

Please refer to FIG. 2 showing an assembled cross sectional view of the present invention (accompanied by FIG. 3). In assembly, the movable seat 60 is mounted to the head rail 10 from one side to mesh the grooved paths 651 of the pulleys 65 precisely with the guide tracks 13 so that the movable seat 60 is allowed to slide in the accommodating channel 11 thereby. The fixed seat 50 and the cord-winding control device 40 are respectively mounted to both end sides of the accommodating channel 11 of the head rail 10, permitting the cord-winding control device 40 to precisely locate in the positioning recesses 131 thereof. Then, the movable seat 60 is situated between the cord-winding control device 40 and the fixed seat 50, permitting the supporting legs 613 to abut against the accommodating channel 11 therein. The lift cords 14, 14' are then guided along the bottom surface of the head rail 10 to extend synchronically towards the winding groove 53 of the fixed seat 50 and wind around one guiding element 54 before led to wind continuously back-and-forth in an S-shaped manner onto the other guiding elements 64, 54', 64' thereof in a sequence. Then, the lift cords 14, 14' are synchronically guided to run on the guide rod 55 and the recess 561 of the positioning rod 56 before secured at the ends to form a fixed end 141 thereby. Then, the insert block 45 with the coupling rods 452 attached at one end of the operational cord 44 are respectively guided to force into the insert cavity 661 and the coupling recesses 663 in close engagement therewith, permitting the operational cord 44 to accurately locate at the opening edge 662 and extend in straight line thereby. Therefore, the operational cord 44 and the lift cords 14, 14' are correspondingly linked in movement to actuate the movable seat 60 respectively, completing the assembly of the present invention.

Figure 4:
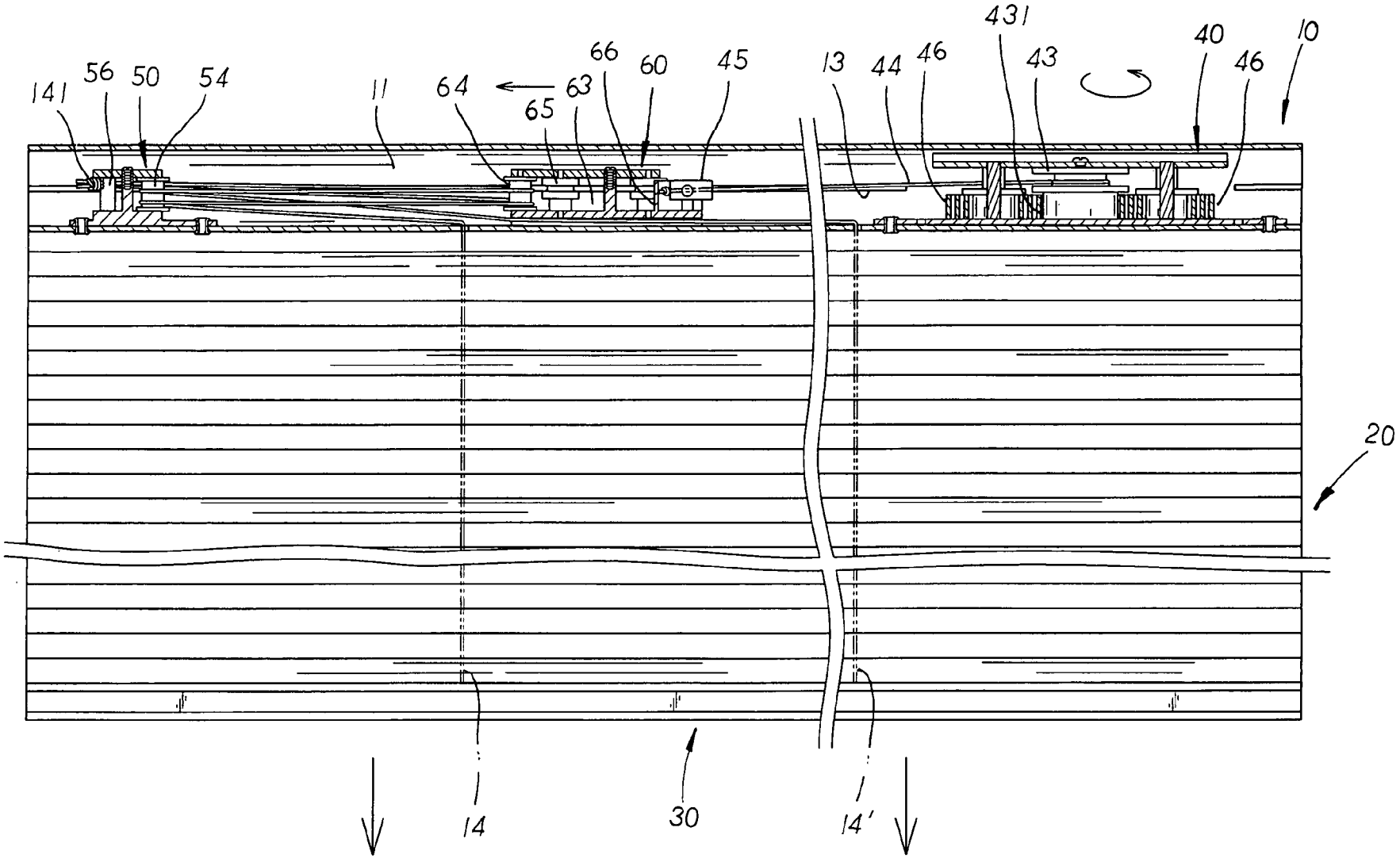
FIG. 4 is a diagram showing a blind body of the present invention expanded downwards in operation.

In operation, when the blind body 20 (referring to FIG. 4) is to be expanded downwards, the bottom rail 30 is pulled downward by hands, and the lift cords 14, 14' drawn by the bottom rail 30 at the bottommost ends thereof are allowed to run along each guiding element 54, 54', 64, 64' of the fixed seat 50 and the movable seat 60 to release downwards through the cord passages 12 respectively. Meanwhile, the supporting legs 613 and the pulleys 66 of the movable seat 60 actuated by the lowering of the lift cords 14, 14' will slide on the accommodating channel 11 and the guide tracks 13 respectively to move towards the fixed seat 50 thereof. Then, the operational cord 44 is synchronically drawn to extend along with the sliding of the movable seat 60, actuating the rotary seat 43 of the cord-winding control device 40 spinning along therewith to release the operational cord 44 thereby. And, the two torsion springs 46 juxtaposed to augment the elasticity thereby will be affected by the pulling force to revolve in an opposite and S-shaped rotation with a constant torque naturally occurred to counter wind thereby. Then, the constant torque occurred works in a linear operation and the torque will not be altered due to the increase of the coils wound, reinforcing the strengthen of the blind body 20 affected by the pulling force to achieve efficient suspension thereby.

Figure 5:
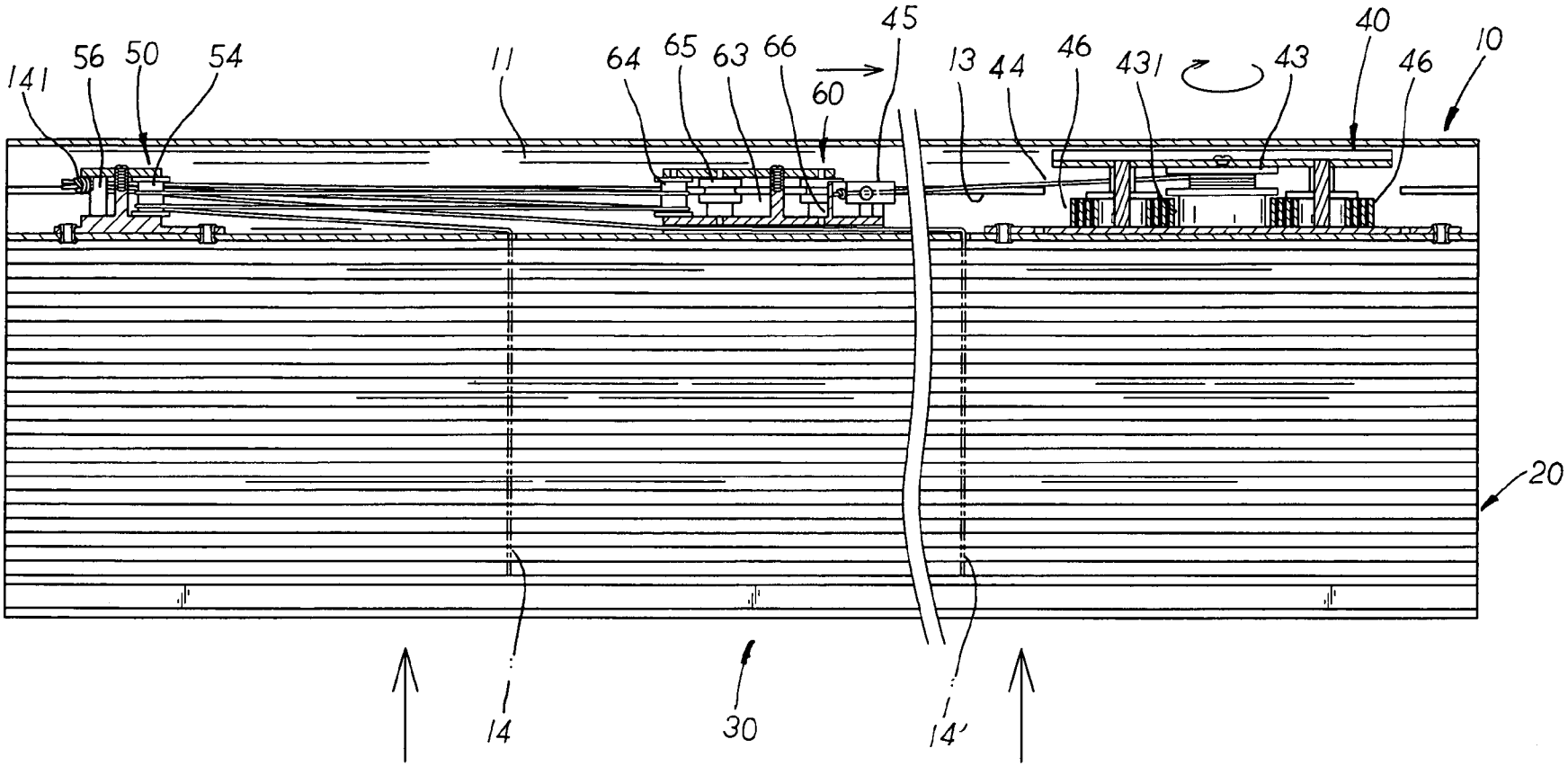
FIG. 5 is a diagram showing the blind body of the present invention collected upwards in operation.

When the blind body 20 (referring to FIG. 5) is to be collected upwards, the bottom rail 30 is pushed upwards by the hands, and the counter-wound torsion springs 46 will be released to naturally recoil backwards, permitting the rotary seat 43 to spin towards the other side with a constant torque occurred at the same time. Then, the movable seat 60 freed from the pulling force of the loosened lift cords 14, 14' is actuated by the recoiling force of the withdrawing operational cord 44 to slide towards the cord-winding control device 40 thereof. Meanwhile, the lift cords 14, 14' are drawn by the sliding movement of the movable seat 60 to run along the guiding elements 54, 54', 64, 64' sequentially and retrieve upwards through the cord passages 12 so as to collect the blind body 20 thereby. Therefore, via the pushing and pulling forces exerted by the hands to cooperatively work with the cord-winding control device 40 to generate constant torques in linking movement thereof, the present invention can prevent the hands from getting abraded by the pull cords found in the conventional window blinds so that a user can freely adjust the blind body 20 into a desirable position. In addition, the movable seat 60 and the fixed seat 50 are respectively equipped with a winding groove 53, 63 for multiple guiding elements 54, 54', 64, 64' mounted thereto so that the lift cords 14, 14' can be accurately wound thereon to achieve positioning and guiding purposes thereby, facilitating smooth and easy expansion and collection of the blind body 20 in operation thereby.

What is claimed is:

1. A non-pull cord operable window blind structure, comprising a head rail with an accommodating channel defining thereon wherein the bottom surface of the accommodating channel has multiple cord passages disposed thereon and both end sides thereof are respectively secured a cord-winding control device and a fixed seat; besides, a movable seat is mounted to situate between the cord-winding control device and the fixed seat and allowed to freely slide in the accommodating channel thereof; a blind body is attached to the underside of the head rail at one end edge and fixed to a bottom rail at the other end edge thereof; multiple lift cords are mounted to the corresponding positions of the blind body and the bottom rail, and are respectively guided to pass through the cord passages of the head rail; the fixed seat and the movable seat are respectively equipped with multiple guiding elements for the winding of each lift cord thereon to achieve guiding purpose thereby; in addition, an operational cord is attached to the cord-winding control device at one end and fixed to an insert block at the other end thereof wherein the insert block is firmly mounted to an insert cavity of a positioning block disposed at one side of the movable seat thereof, permitting the operational cord to correspondingly move in linkage to the lift cords wound onto the movable seat and the fixed seat thereof; therefore, the bottom rail is simply pushed or pulled by hands to loosen or tighten the lift cords wound on the movable seat, and actuate the movement of the operational cord therewith to form a state of counterbalance there-between, permitting a user to easily and smoothly adjust the blind body into a desirable collected or expanded position thereby, wherein the fixed seat and the movable seat are respectively equipped with a set of bottom and upper boards to form a winding groove there-between for the mounting of the guiding elements thereon; the positioning block of the movable seat is situated to protrude at one side of the bottom board thereon, and an opening edge is disposed at one end of the positioning block to communicate with the insert cavity thereof; besides, both side walls of the insert cavity thereof have a set of coupling recesses symmetrically indented thereon.

2. The non-pull cord operable window blind structure as claimed in claim 1 wherein the cord-winding control device is equipped with a base, a top plate, and a rotary seat that, mounted between the base and the top plate, has the operational cord attached and wound thereto; the bottom surface of the rotary seat has a smaller-diameter rotating shaft protruding thereon, and both sides of the rotating shaft have a torsion spring mounted thereto respectively so that, depending on the actuation of the operational cord and the clockwise/counter-clockwise spinning direction of the rotary seat, the torsion springs are allowed to wind or counter-wind along the rotating shaft and elastically locate in place thereby.

3. The non-pull cord operable window blind structure as claimed in claim 1 wherein the insert block thereof has a bore drilled therein for the extension of the operation cord there-through before fixed to form a stably attached end thereby; besides, the insert block also has a coupling rod protruding at both lateral sides thereon respectively.

4. The non-pull cord operable window blind structure as claimed in claim 1 wherein the amount of the guiding elements of the fixed and the movable seats can be determined by the length of the lift cords and set into two or more than two in number.

5. The non-pull cord operable window blind structure as claimed in claim 1 wherein the winding groove of the fixed seat has a guide rod and a positioning rod with a recess cut thereon disposed at one lateral side thereon, to which the lift cords are synchronically guided to run and wind thereon with the ends firmly secured to form a fixed end thereby.

6. The non-pull cord operable window blind structure as claimed in claim 1 wherein the bottom board of the movable seat also includes supporting legs extending downwards at the underside thereon.

7. The non-pull cord operable window blind structure as claimed in claim 1 wherein the movable seat and the head rail are respectively equipped with multiple pulleys each defined by a grooved path, and a set of guide tracks each defined by a positioning recess, permitting the pulleys of the movable seat to slide along the guide tracks of the head rail in operation.

8. A non-pull cord operable window blind structure, comprising a head rail with an accommodating channel defining thereon wherein the bottom surface of the accommodating channel has multiple cord passages disposed thereon and both end sides thereof are respectively secured a cord-winding control device and a fixed seat; besides, a movable seat is mounted to situate between the cord-winding control device and the fixed seat and allowed to freely slide in the accommodating channel thereof; a blind body is attached to the underside of the head rail at one end edge and fixed to a bottom rail at the other end edge thereof; multiple lift cords are mounted to the corresponding positions of the blind body and the bottom rail, and are respectively guided to pass through the cord passages of the head rail; the fixed seat and the movable seat are respectively equipped with multiple guiding elements for the winding of each lift cord thereon to achieve guiding purpose thereby; in addition, an operational cord is attached to the cord-winding control device at one end and fixed to an insert block at the other end thereof wherein the insert block is firmly mounted to an insert cavity of a positioning block disposed at one side of the movable seat thereof, permitting the operational cord to correspondingly move in linkage to the lift cords wound onto the movable seat and the fixed seat thereof; therefore, the bottom rail is simply pushed or pulled by hands to loosen or tighten the lift cords wound on the movable seat, and actuate the movement of the operational cord therewith to form a state of counterbalance there-between, permitting a user to easily and smoothly adjust the blind body into a desirable collected or expanded position thereby, wherein the insert block thereof has a bore drilled therein for the extension of the operation cord there-through before fixed to form a stably attached end thereby; besides, the insert block also has a coupling rod protruding at both lateral sides thereon respectively.

9. A non-pull cord operable window blind structure, comprising a head rail with an accommodating channel defining thereon wherein the bottom surface of the accommodating channel has multiple cord passages disposed thereon and both end sides thereof are respectively secured a cord-winding control device and a fixed seat; besides, a movable seat is mounted to situate between the cord-winding control device and the fixed seat and allowed to freely slide in the accommodating channel thereof; a blind body is attached to the underside of the head rail at one end edge and fixed to a bottom rail at the other end edge thereof; multiple lift cords are mounted to the corresponding positions of the blind body and the bottom rail, and are respectively guided to pass through the cord passages of the head rail; the fixed seat and the movable seat are respectively equipped with multiple guiding elements for the winding of each lift cord thereon to achieve guiding purpose thereby; in addition, an operational cord is attached to the cord-winding control device at one end and fixed to an insert block at the other end thereof wherein the insert block is firmly mounted to an insert cavity of a positioning block disposed at one side of the movable seat thereof, permitting the operational cord to correspondingly move in linkage to the lift cords wound onto the movable seat and the fixed seat thereof; therefore, the bottom rail is simply pushed or pulled by hands to loosen or tighten the lift cords wound on the movable seat, and actuate the movement of the operational cord therewith to form a state of counterbalance there-between, permitting a user to easily and smoothly adjust the blind body into a desirable collected or expanded position thereby, wherein the movable seat and the head rail are respectively equipped with multiple pulleys each defined by a grooved path, and a set of guide tracks each defined by a positioning recess, permitting the pulleys of the movable seat to slide along the guide tracks of the head rail in operation.

* * * * *